US008030978B2

(12) United States Patent
Tseng

(10) Patent No.: US 8,030,978 B2
(45) Date of Patent: Oct. 4, 2011

(54) SOFT-START CIRCUIT

(75) Inventor: Jyi-Hung Tseng, Sinshih Township, Tainan County (TW)

(73) Assignee: Himax Analogic, Inc., Tainan County (TW)

( * ) Notice: Subject to any disclaimer, the term of this patent is extended or adjusted under 35 U.S.C. 154(b) by 424 days.

(21) Appl. No.: 12/419,337

(22) Filed: Apr. 7, 2009

(65) Prior Publication Data

US 2010/0253297 A1 Oct. 7, 2010

(51) Int. Cl.
*H01H 3/00* (2006.01)

(52) U.S. Cl. ..... 327/142; 323/901; 327/143

(58) Field of Classification Search ..... 323/901; 327/142, 143; 363/49
See application file for complete search history.

(56) References Cited

U.S. PATENT DOCUMENTS 7,180,757 B2 * 2/2007 Chen et al. ..... 363/49
7,560,915 B2 * 7/2009 Ito et al. ..... 323/282
7,948,284 B2 * 5/2011 Watanabe et al. ..... 327/143

* cited by examiner

*Primary Examiner* — Shawn Riley
(74) *Attorney, Agent, or Firm* — Thomas, Kayden, Horstemeyer & Risley, LLP

(57) ABSTRACT

A soft-start circuit is provided. The soft-start circuit comprises: an input stage, a pump stage, a second resistor and a capacitor. The input stage comprises a first resistor to receive an input voltage to provide a reference current at a first node. The pump stage comprises N current branches connected in parallel each comprising a current source connected to the first node and a switch to transfer the current from the current source to the second node while the switch operates in a connecting state. The switches has $2^N$ connecting modes performed one after another to generate an output current with a gradual increment output current at the second node with $2^N$ current levels; and the second resistor and the capacitor are connected in parallel between the second node and the ground potential to generate an output voltage with a gradual increment with $2^N$ voltage levels according to output current.

11 Claims, 3 Drawing Sheets

SOFT-START CIRCUIT

BACKGROUND

1. Field of Invention

The present invention relates to a soft-start circuit. More particularly, the present invention relates to a soft-start circuit to generate an output voltage with a gradual positive or negative increment to provide a soft-start mechanism.

2. Description of Related Art

When an electronic device is used, it is desirable to extend the time period to fully power the device in order to control the high inrush or surge current at turn on. If the current is not controlled, damage may be done to the device's connectors and components. Accordingly, a soft-start is performed by controlling the ramp-up rate of the applied voltage in order to protect the electronic devices. The soft-start circuit can provide the soft-start mechanism and is widely adopted. However, the accurate control over each voltage step of the ramp-up process and the ramp-up rate is the critical issue concerning to the performance of the soft-start circuit. The conventional soft-start circuit makes use of a plurality of resistors, which are easy to suffer from the temperature effect, to generate the voltage steps during the ramp-up process. Thus, the accuracy of the soft-start circuit with multi-resistor structure is not reliable.

Accordingly, what is needed is a soft-start circuit to generate an output voltage with a gradual positive or negative increment and with high accuracy to provide a soft-start mechanism. The present invention addresses such a need.

SUMMARY

A soft-start circuit is provided. The soft-start circuit comprises: an input stage, a pump stage, a second resistor and a capacitor. The input stage is to receive an input voltage to provide a reference current at a first node, wherein the input stage comprises a first resistor such that the value of the reference current is the ratio of the input voltage and the first resistor. The pump stage comprises N current branches connected in parallel each comprising a current source connected to the first node and a switch connected to a second node to transfer the current from the current source to the second node while the switch operates in a connecting state and stop transferring the current while the switch operates in a disconnecting state, the switches has $2^N$ connecting modes performed one after another to generate an output current with a gradual increment at the second node with $2^N$ current levels; and the second resistor and the capacitor are connected in parallel between the second node and the ground potential to receive the output current to generate an output voltage with a gradual increment with $2^N$ voltage levels according to the multiple of the value of output current and the second resistor at the second node.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1:
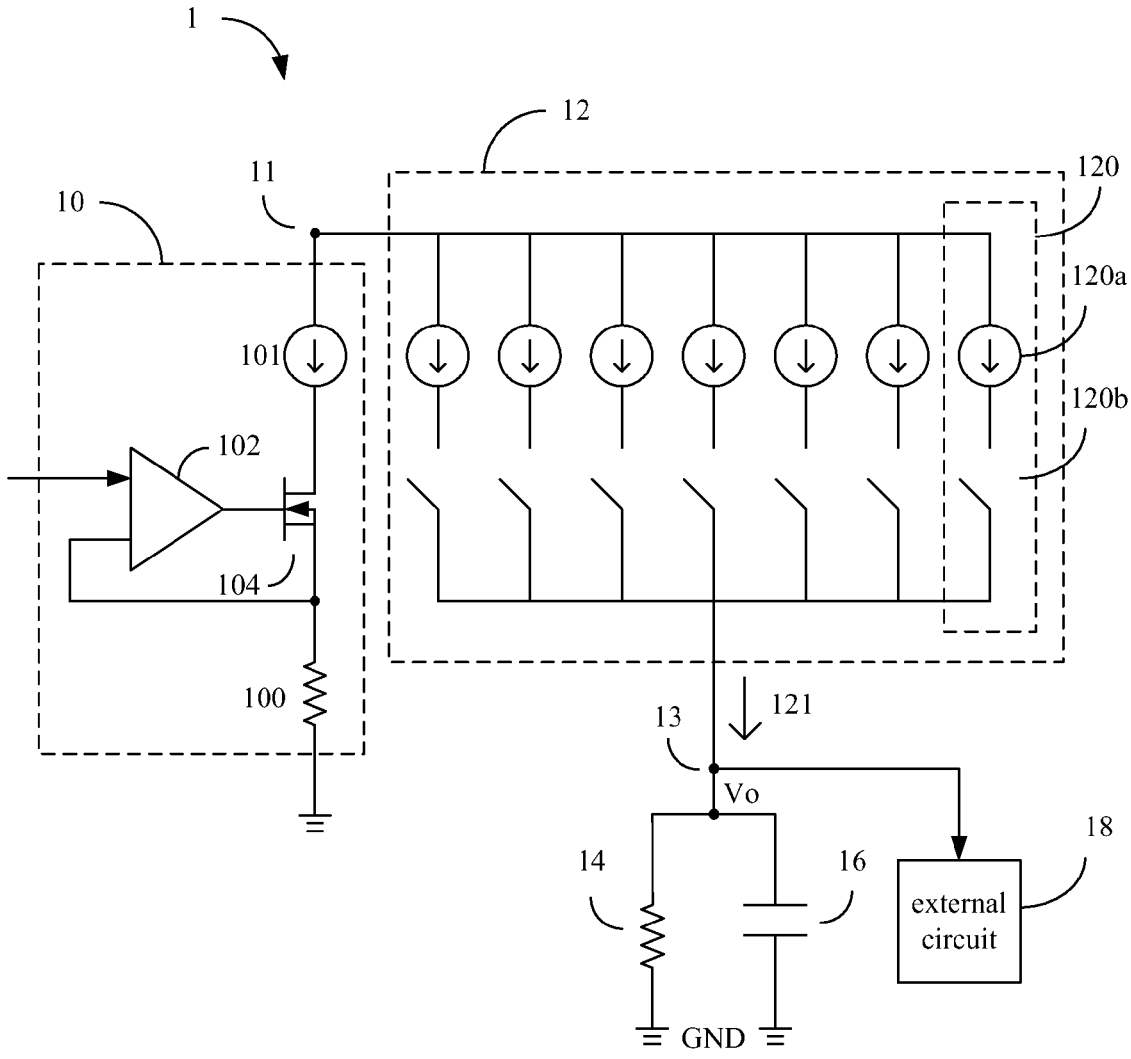
FIG. 1 is a diagram of a soft-start circuit of the first embodiment of the present invention.

Reference will now be made in detail to the present embodiments of the invention, examples of which are illustrated in the accompanying drawings. Wherever possible, the same reference numbers are used in the drawings and the description to refer to the same or like parts.

Please refer to FIG. 1. FIG. 1 is a diagram of a soft-start circuit 1 of the first embodiment of the present invention. The soft-start circuit 1 comprises an input stage 10, a pump stage 12, a second resistor 14 and a capacitor 16. The input stage 10 is to receive an input voltage Vi to provide a reference current 101 at a first node 11, wherein the input stage 10 comprises a first resistor 100 such that the value of the reference current 101 is the ratio of the input voltage Vi and the resistance $R_1$ of the first resistor 100. If the value of the reference current is Ir, then the relation of the reference current 101, input voltage Vi and the resistance $R_1$ can be represented as $Ir=Vi/R_1$. In the present embodiment, the input stage 10 comprises an operational amplifier 102 and a NMOS 104, wherein the operational amplifier 102 substantially receives the input voltage Vi to control the NMOS 104 to generate the reference current 101. In other embodiments, other circuits can be adopted to generate the reference current.

The pump stage 12 in the present embodiment comprises seven current branches 120 connected in parallel each comprising a current source 120*a* connected to the first node 11 and a switch 120*b* connected to a second node 13 to transfer the current from the current source 120*a* to the second node 120*b* while the switch 120*b* operates in a connecting state and stop transferring the current while the switch 120*b* operates in a disconnecting state. The seven current branches 120 has seven switches 120*b*, thus the seven switches 120*b* has $2^7$ connecting modes performed one after another to generate an output current 121 with a gradual increment at the second node 13 with $2^7$, which is 128, current levels. For the connecting mode that no switch operates in the connecting state, the pump stage 12 doesn't generate any output current. For the connecting mode that only one switch operates in the connecting state, the pump stage 12 generates the minimum amount of the output current 121. And for the connecting mode that all the switches operate in the connecting state, the pump stage 12 generates the maximum amount of the output current 121. In an embodiment, when the value of the reference current 101 is Ir, the values of the current sources 120*a* of the seven current branches 120 are designed to be $Ir/2^1$, $Ir/2^2$, $Ir/2^3$, . . . , $Ir/2^7$ respectively. Thus, the maximum of the output current 121 is $(1/2^1+1/2^2+1/2^3+\ldots+1/2^7)*Ir$, which is an approximation of the reference current 101. It's noticed that in other embodiment, the ratio of the current of the current branches can be different. The connecting modes thus switch from the first connecting mode that generates no current to the last connecting mode that generates the maximum output current 121 to make the output current 121 gradually increase. Also, the ramp-up rate of the output current 121 can be fine tuned by adjusting the switch rate of the connecting modes. It's noticed that in the present embodiment, the gradual increment of the output current is a positive increment. However, in another embodiment, if an output current with a negative value is generated, the gradual increment of the output current is a negative increment. The connecting modes in the present embodiment switch from the first connecting mode that generates no current to the last connecting mode that generates the most negative output current to make the output current gradually and negatively increase.

The second resistor 14 and the capacitor 16 are connected in parallel between the second node 13 and the ground potential GND to receive the output current 121 to generate a gradually increasing output voltage Vo with $2^7$ voltage levels according to the multiple of the value of output current 121 and the second resistor 14 at the second node 13. If the value of the output voltage is Vo, the resistance of the second resistor 14 is $R_2$ and the output current is Io, then the relation of the output voltage, the second resistor and the output current is $Vo=R_2*Io$. When the output current 121 reaches the maximum value as described above, the output voltage $Vo=R_2*Io=R_2*(1/2^1+1/2^2+1/2^3+\ldots+1/2^7)*Ir=R_2*(1/2^1+1/2^2+1/2^3+\ldots+1/2^7)*Vi/R_1$. It's noticed that the value $1/2^1+1/2^2+1/2^3+\ldots+1/2^7$ is the approximation of 1, thus, the above equation can be simplified as $Vo=Vi*R_2/R_1$. When the first and the second resistors 100 and 14 have the same resistance value, the maximum of the output voltage Vo is the approximation of the input voltage Vi. In another embodiment, when the second resistor 14 has a larger resistance value then the first resistor 100, the maximum of the output voltage Vo is larger than the input voltage Vi. Thus, the value of the output voltage Vo can be fine tuned through the design of the ratio of the first and the second resistor 100 and 14. The soft-start mechanism of the output voltage Vo and the output current 121 provided by the different connecting mode of the switches described above can thus prevent an external circuit 18 connected to the second node 13 receiving the output voltage Vo from the high inrush or surge current. It's noticed that, in another embodiment, the output voltage can be a negative value if the output current is a negative output current. Thus, the gradual increment of the output voltage is a negative increment. When the connecting modes switch from the first connecting mode to the last connecting mode, the output voltage gradually and negatively increase as well.

The soft-start circuit of the present embodiment of the present invention uses different connecting modes to switch from the first connecting mode that generates no current to the last connecting mode that generates the maximum output current to make the output current and the output voltage gradually increase to accomplish the soft-start mechanism. The current sources of the current branches in the pump stage are much more stable then resistors, which is easy to suffer from the temperature effect. Thus, the soft-start circuit of the present embodiment of the present invention provides more accurate voltage steps of the ramp-up process and the ramp-up rate.

Figure 2:
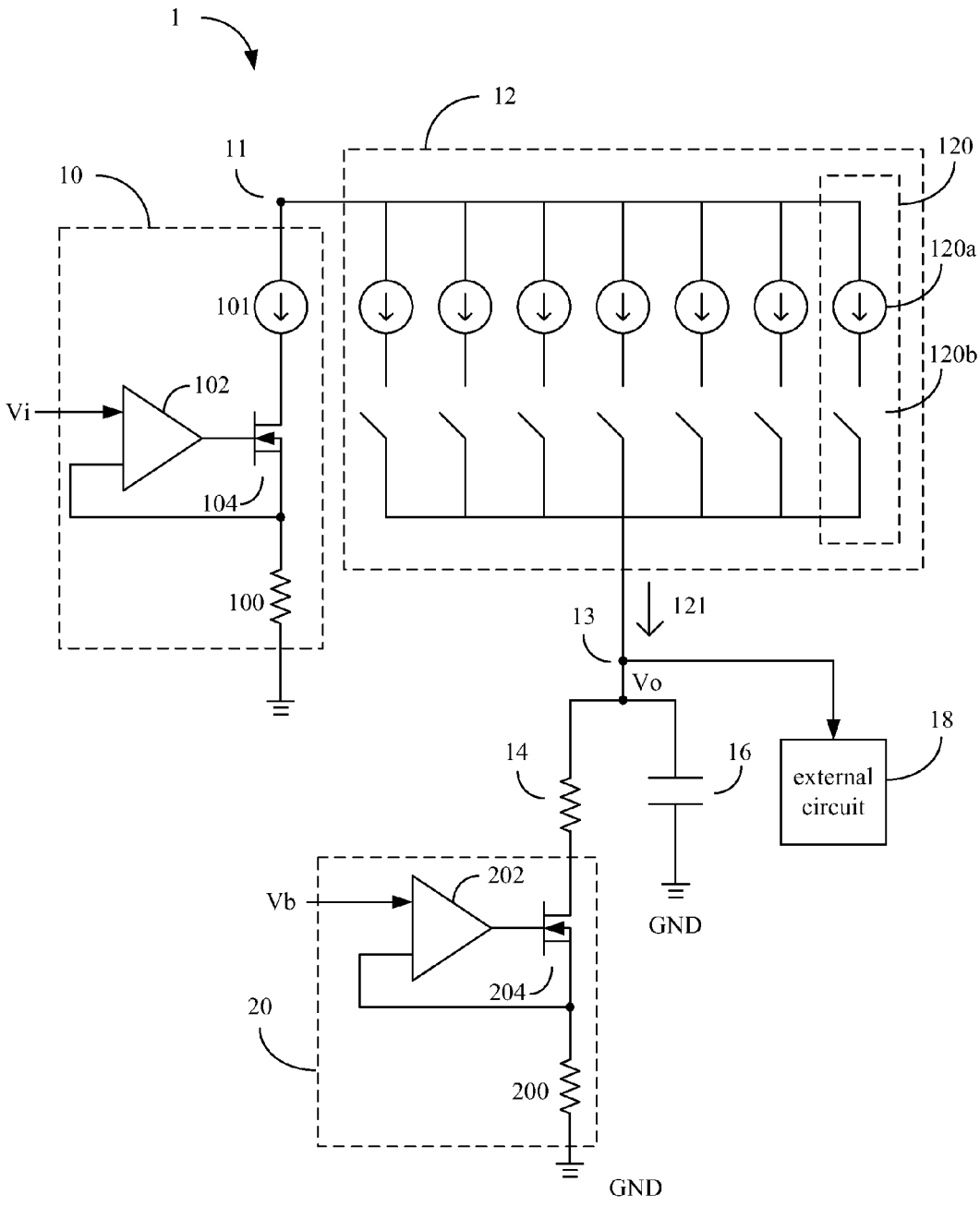
FIG. 2 is a diagram of a soft-start circuit of the second embodiment of the present invention.

Please refer to FIG. 2. FIG. 2 is a diagram of a soft-start circuit 2 of the second embodiment of the present invention. The soft-start circuit 2 of the present embodiment is similar to the first embodiment. However, the soft-start circuit 2 further comprises a lower bound voltage module 20 substantially connected between the second resistor 14 and the ground potential GND, wherein the lower bound voltage module 20 is to transfer a lower bound voltage Vb to the second node 13 such that the voltage at the second node 13 is the sum of the output voltage Vo and the lower bound voltage Vb. It's noticed that the lower bound voltage module 20 of the present embodiment comprises a resistor 200, an operational amplifier 202 and a NMOS 204, wherein the operational amplifier 202 substantially receives the lower bound voltage Vb to control the NMOS 204 to transfer the lower bound voltage Vb. In other embodiments, other circuits can be adopted to transfer the lower bound voltage. The lower bound voltage Vb provides an additional voltage to make the external circuit 18 receive a maximum voltage higher than the input voltage Vo. The value of the lower bound voltage Vb can be adjusted according to different applications.

Figure 3:
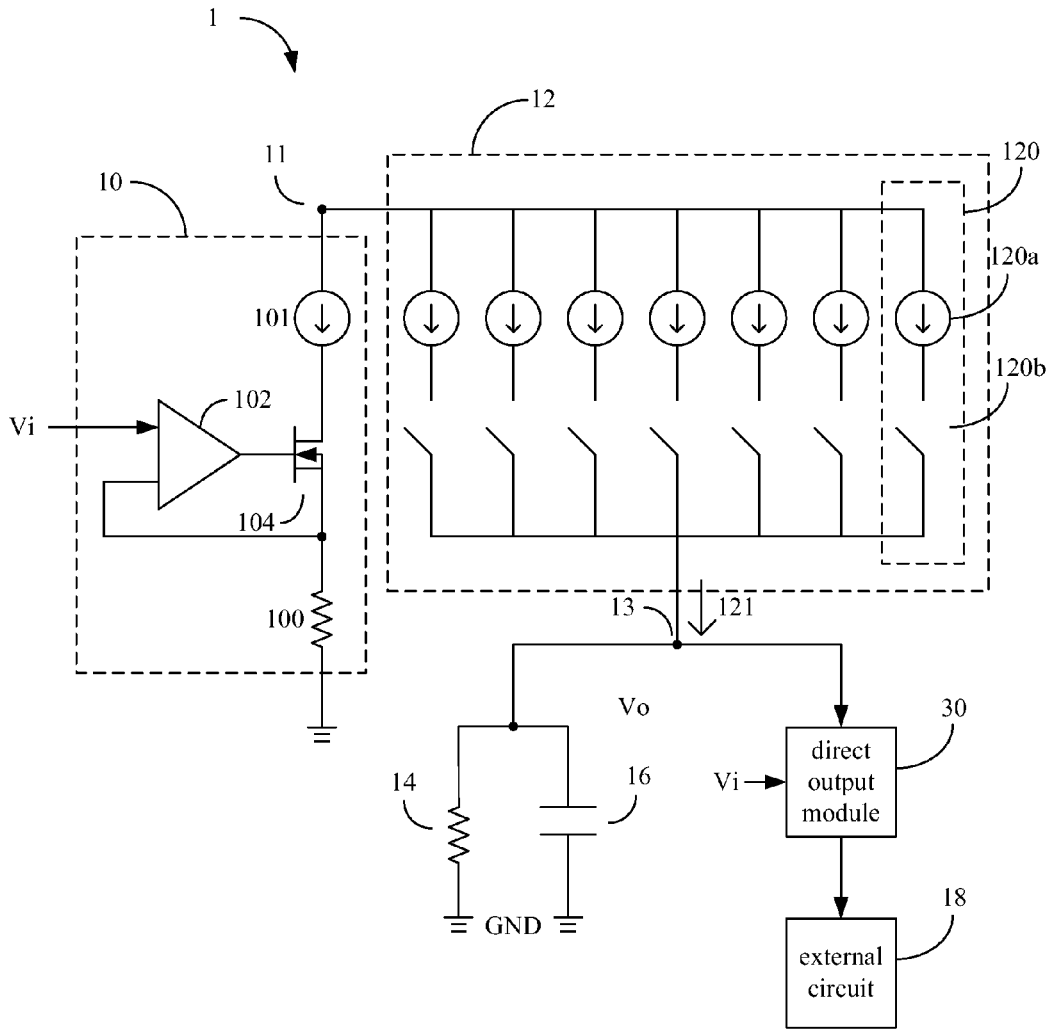
FIG. 3 is a diagram of a soft-start circuit of the third embodiment of the present invention.

Please refer to FIG. 3. FIG. 3 is a diagram of a soft-start circuit 3 of the third embodiment of the present invention. The soft-start circuit 3 of the present embodiment is similar to the first embodiment. However, the soft-start circuit 3 further comprises a direct output module 30, wherein the external circuit 18 in the present embodiment is connected to the direct output module 30. The direct output module 30 receives the output voltage Vo from the second node 13, such that when all the switches of 120*b* of the pump stage 12 operate in the connecting state to make the output voltage Vo reach the maximum, the direct output module 30 directly transfer the input voltage Vi to the external circuit 18. It's noticed that the maximum of the output voltage Vo in the first embodiment is only the approximation of the input voltage Vi. Thus, if the external circuit 18 needs a precise voltage level, the direct output module 30 can be used to provide the precise output voltage after the soft-start process. Further, the present embodiment can apply to the second embodiment as well, such that when all the switches operate in the connecting state to make the output voltage Vo reach the maximum, the direct output module 30 directly transfer the sum of the input voltage Vi and the lower bound voltage Vb to the external circuit 18.

The soft-start circuit of the present invention can generate an output voltage with a gradual increment with the use of the current sources and the switches to provide a soft-start mechanism the voltage steps with high accuracy and high stability. Further, the level of the maximum output voltage can be fine tuned by adjusting ratio the first and the second resistors or by adjusting the lower bound voltage. Also, the direct output module can maintain the accuracy of the maximum output voltage.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A soft-start circuit comprising:

an input stage to receive an input voltage to provide a reference current at a first node, wherein the input stage comprises a first resistor such that the value of the reference current is the ratio of the input voltage and the first resistor;

a pump stage comprising N current branches connected in parallel each comprising a current source connected to the first node and a switch connected to a second node to transfer the current from the current source to the second node while the switch operates in a connecting state and stop transferring the current while the switch operates in a disconnecting state, the switches has $2^N$ connecting modes performed one after another to generate an output current with a gradual increment at the second node with $2^N$ current levels; and a second resistor and a capacitor connected in parallel between the second node and the ground potential to receive the output current to generate an output voltage with a gradual increment with $2^N$ voltage levels according to the multiple of the value of output current and the second resistor at the second node.

2. The soft-start circuit of claim 1, wherein the value of the reference current is I, the values of the current sources of the N current branches are $I/2^1$, $I/2^2$, $I/2^3$, . . . , $I/2^N$ respectively.

3. The soft-start circuit of claim 2, wherein the first and the second resistors have the same resistance value, the maximum of the output voltage is an approximation of the input voltage.

4. The soft-start circuit of claim 3, wherein an external circuit is connected to the second node to receive the output voltage.

5. The soft-start circuit of claim 1, further comprising a direct output module, wherein an external circuit is connected to the direct output module, the direct output module receives the output voltage from the second node, when all the switches operate in the connecting state to make the output voltage reach the maximum, the direct output module directly transfer the input voltage to the external circuit.

6. The soft-start circuit of claim 2, wherein second resistor has a larger resistance value then the first resistor, the maximum of the output voltage is larger than the input voltage.

7. The soft-start circuit of claim 1, further comprising a lower bound voltage module substantially connected between the second resistor and the ground potential, wherein the lower bound voltage module is to transfer a lower bound voltage to the second node such that the voltage at the second node is the sum of the output voltage and the lower bound voltage.

8. The soft-start circuit of claim 7, wherein an external circuit is connected to the second node to receive the output voltage and the lower bound voltage.

9. The soft-start circuit of claim 7, further comprising a direct output module, wherein an external circuit is connected to the direct output module, the direct output module receives the output voltage from the second node, when all the switches operate in the connecting state to make the output voltage reach the maximum, the direct output module directly transfer the sum of the input voltage and the lower bound voltage to the external circuit.

10. The soft-start circuit of claim 1, wherein the gradual increments of the output current and the output voltage are positive increments.

11. The soft-start circuit of claim 1, wherein the gradual increments of the output current and the output voltage are negative increments.

* * * * *